US010155649B2

(12) United States Patent
Koland et al.

(10) Patent No.: US 10,155,649 B2
(45) Date of Patent: Dec. 18, 2018

(54) DIP TUBE ASSEMBLIES

(71) Applicant: ENTEGRIS, INC., Billerica, MA (US)

(72) Inventors: Amy Koland, Eden Prairie, MN (US); Rick Wilson, Edina, MN (US)

(73) Assignee: Entegris, Inc., Billerica, MA (US)

( * ) Notice: Subject to any disclaimer, the term of this patent is extended or adjusted under 35 U.S.C. 154(b) by 0 days.

(21) Appl. No.: 15/029,497

(22) PCT Filed: Oct. 17, 2014

(86) PCT No.: PCT/US2014/061148
§ 371 (c)(1),
(2) Date: Apr. 14, 2016

(87) PCT Pub. No.: WO2015/058090
PCT Pub. Date: Apr. 23, 2015

(65) Prior Publication Data

US 2016/0264393 A1 Sep. 15, 2016

Related U.S. Application Data

(60) Provisional application No. 61/892,529, filed on Oct. 18, 2013.

(51) Int. Cl.
*B67D 1/08* (2006.01)
*B67D 1/04* (2006.01)
(Continued)

(52) U.S. Cl.
CPC ..... *B67D 1/0802* (2013.01); *B67D 1/0462* (2013.01); *B67D 1/0829* (2013.01);
(Continued)

(58) Field of Classification Search
CPC .. B67D 1/0802; B67D 1/0462; B67D 1/0829; B67D 7/0255; B67D 7/0261; B67D 7/0288; B67D 2001/0825; B67D 1/125
See application file for complete search history.

(56) References Cited

U.S. PATENT DOCUMENTS 5,102,010 A 4/1992 Osgar et al.
5,860,574 A 1/1999 Shanklin et al.
(Continued)

FOREIGN PATENT DOCUMENTS

CN 1472012 A 2/2004
EP 0557913 B1 7/1997
(Continued)

*Primary Examiner* — Nicholas J Weiss
(74) *Attorney, Agent, or Firm* — Entegris, Inc.

(57) ABSTRACT

A dip tube assembly having a tubular portion and a coupler portion, the coupler configured for removable coupling with the mouth of a container storing contents therein. The coupler portion comprises a first end for connection with a tubular portion; a second end for connection with a connector assembly, wherein the connector assembly provides a pressure to the container; an outer surface and an inner surface with a thickness therebetween, wherein the inner surface defines a lumen that allows the chemical fluid to be conveyed from the chamber through the tubular portion to the connector assembly; and at least one pressure relief feature on the outer surface.

14 Claims, 4 Drawing Sheets

(51) Int. Cl.
*B67D 7/02* (2010.01)
*B67D 1/12* (2006.01)

(52) U.S. Cl.
CPC ..... *B67D 1/125* (2013.01); *B67D 7/0255* (2013.01); *B67D 7/0261* (2013.01); *B67D 7/0288* (2013.01); *B67D 2001/0825* (2013.01)

(56) References Cited

U.S. PATENT DOCUMENTS

| | | | | |
|---|---|---|---|---|
| 7,335,721 | B2 | 2/2008 | Alberg | |
| 8,313,821 | B2 | 11/2012 | Yan et al. | |
| 9,079,758 | B2 | 7/2015 | O'Dougherty et al. | |
| 2009/0020176 | A1 | 1/2009 | Fuchs et al. | |
| 2009/0212071 | A1 | 8/2009 | Tom et al. | |
| 2010/0112815 | A1 | 5/2010 | O'Dougherty et al. | |
| 2011/0187028 | A1 | 8/2011 | Menning et al. | |
| 2012/0187153 | A1 | 7/2012 | Burge et al. | |
| 2012/0248109 | A1 | 10/2012 | Fuchs et al. | |
| 2012/0291627 | A1* | 11/2012 | Tom ..... | B67D 7/0261 95/8 |
| 2015/0314316 | A1* | 11/2015 | Kusz ..... | B05B 15/005 222/105 |

FOREIGN PATENT DOCUMENTS

| | | | |
|---|---|---|---|
| EP | 1097899 | A1 | 5/2001 |
| JP | S52-159414 | U | 12/1977 |
| JP | S56-091294 | U | 7/1981 |
| JP | S58-029996 | U | 2/1983 |
| JP | 2007-204101 | A | 8/2007 |
| JP | 2008-536767 | A | 9/2008 |
| KR | 100973707 | B1 | 8/2010 |
| WO | WO 2007090120 | A2 | 8/2007 |
| WO | WO 2009076101 | A1 | 6/2009 |
| WO | WO 2011006146 | A2 | 1/2011 |
| WO | WO 2011046802 | A2 | 4/2011 |
| WO | WO 2012051093 | A2 | 4/2012 |
| WO | WO 2012071370 | A2 | 5/2012 |
| WO | WO 2012071376 | A2 | 5/2012 |
| WO | WO 2012078977 | A2 | 6/2012 |
| WO | WO 2012/118527 | A1 | 9/2012 |
| WO | WO 2013/074923 | A1 | 5/2013 |
| WO | 2013/096579 | A1 | 6/2013 |

* cited by examiner

DIP TUBE ASSEMBLIES

RELATED APPLICATIONS

This application is a National Phase entry of PCT Application No. PCT/US2014/061148, filed October 17, which claims the benefit of U.S. Provisional Patent Application No. 61/892,529, filed Oct. 18, 2013, the disclosures of which are hereby incorporated by reference herein in their entireties.

FIELD OF THE INVENTION

The present disclosure relates to improved dip tube assemblies and methods for manufacturing the same.

BACKGROUND OF THE INVENTION

Container systems may be used in many industries for storing, shipping and/or dispensing materials of any viscosity. For example, numerous manufacturing processes require the use of ultrapure liquids, such as acids, solvents, bases, photoresists, slurries, cleaning formulations, dopants, inorganic, organic, metalorganic and biological solutions, pharmaceuticals, and radioactive chemicals. Further many other industries use container systems for a variety of applications, for example the food industry, pharmaceutical industry, cosmetic industry, etc. Typically, a shipping and dispensing system will include a container of some kind, and/or a liner, a cap that may be used to seal and protect the contents of the storage system when the contents are not being dispensed, and a connector that may be used to dispense the contents from the container. The liner and or container may include a fitment that allows caps, connectors, or other coupling devices to be coupled with the container system. Some systems further include a dip tube or a dip tube assembly that may assist in dispensing the contents of the container.

Conventional dip tube assemblies may include a relatively long and slender tubular portion that may be generally cylindrically shaped having a given diameter and a given length, often depending on the intended use. The tubular portion may be configured for placement so as to extend into an interior cavity of a liner or other container. To assist in proper placement of the tubular portion, the tubular portion may be configured to cooperate with a coupler portion that is shaped and configured to substantially fit into, or adjacent to, the mouth of the liner or other container, such as by fitting into or adjacent to, or coupling with, a fitment portion of the liner or other container, so as to generally fixedly couple or connect the tubular portion with the liner or other container. The tubular portion and coupler portion may be, and often are, separate stand-alone parts. For example, the tubular portion may often be a standard tube and the coupler portion may be a particularly custom part designed to permit coupling between the standard tube and a custom dispense container. In this regard, the coupler portion may often be configured with a tubular receiving cavity designed to receive and accommodate liquid-tight insertion of the tubular portion and an exterior designed to substantially fit into, or adjacent to, the mouth or fitment portion of a particular model container or other custom container.

One such known dip tube assembly includes a coupler portion having a receiving cavity that has a generally circular opening and a diameter cross-section that slightly tapers or narrows moving further into the receiving cavity, away from the entrance thereof, so as to form a conical frustrum. The tubular portion of the dip tube assembly may be inserted into the opening of the conical frustrum shaped receiving cavity of the coupler in friction-fit or press-fit style, thereby snuggly holding the tubular portion in generally fixed attachment with the coupler portion for sealability.

Another known dip tube assembly includes a coupler portion that is configured at one end for insertion into a top end of the tubular portion, in somewhat reverse fashion to the previously described embodiment. In order to insert the end of the coupler portion into the top end of the tubular portion, the top end of the tubular portion is first heated on a mandrel to widen the opening, thereby permitting insertion of the coupler end. When cooled, the coupler and tubular portion are thereby coupled via interference fit. Other embodiments of dip tube assemblies are discussed in commonly-owned U.S. Prov. Appl. No. 61/831,202, titled "Dip Tube Assemblies and Methods of Manufacturing the Same," filed Jun. 5, 2013.

In various embodiments of the dip tube assembly, sometimes when the dip tube assembly is seated in the fitment portion, a seal is created to isolate pressure or gas from the chemical stored in the container. However, if the user does not expel all of the chemical in the container, pressure can build and chemical can be undesirably forced out through the dip tube assembly. Accordingly, there is a need for dip tube assemblies that overcome the disadvantages of conventional dip tube assemblies in one or more ways. That is, there is a need for improved dip tube couplers that are capable of relieving pressure to prevent chemical from being unintentionally forced out through the dip tube assembly.

BRIEF SUMMARY OF THE INVENTION

The present disclosure, in one embodiment, relates to a dip tube assembly having a tubular portion and a coupler portion, the coupler configured for removable coupling with the mouth of a container storing contents therein. The coupler portion comprises a first end for connection with a tubular portion; a second end for connection with a connector assembly, wherein the connector assembly provides a pressure to the container; an outer surface and an inner surface with a thickness therebetween, wherein the inner surface defines a lumen that allows the chemical fluid to be conveyed from the chamber through the tubular portion to the connector assembly; and at least one pressure relief feature on the outer surface. In one embodiment, the pressure relief feature comprises at least one pressure relief port. In one embodiment, the pressure relief ports are discrete throughholes extending through the thickness of the coupler portion. In another embodiment, the at least one pressure relief port includes at least one opening in the outer surface and at least one opening in the inner surface with a channel connecting the opening in the outer surface to the opening of the inner surface. In another embodiment, the pressure relief feature comprises a plurality of channels and notches disposed in the outer surface. In another embodiment, the pressure relief feature comprises a lip portion at the first end of the coupler portion. It is contemplated that the coupler portion may comprise one or more of these pressure relief features either alone or in combination in order to allow excess pressure to escape the container without unintentionally expelling fluid from the container.

While multiple embodiments are disclosed, still other embodiments of the present disclosure will become apparent to those skilled in the art from the following detailed description, which shows and describes illustrative embodiments of the disclosure. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the disclosure will be better understood from the following description taken in conjunction with the accompanying Figures, in which:

DETAILED DESCRIPTION

The present disclosure relates to novel and advantageous dip tube systems or assemblies for use with container systems, such as but not limited to, liner-based storage and dispensing systems as will be noted herein.

Figure 1:
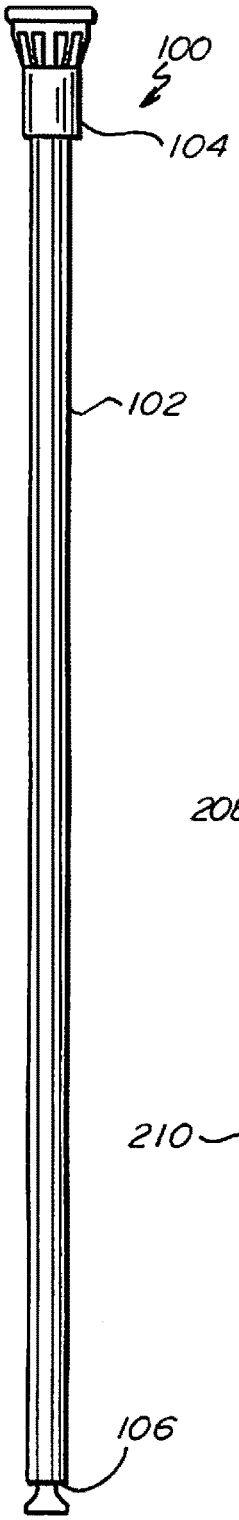
FIG. 1 is a front view of a dip tube assembly in accordance with one embodiment of the present disclosure.

Generally, as illustrated in FIG. 1, a dip tube assembly 100 according to the present disclosure may include a tubular portion 102 and a coupler portion 104. Tubular portion 102 may be generally cylindrically shaped or straw-like with an interior passageway extending generally from one end to the other, as will be understood by those skilled in the art. The tubular portion 102 may be substantially long and slender; however, it is understood that the tubular portion 102 may have any suitable or desirable length and any suitable or desirable exterior diameter as well as interior passageway diameter. Often the length and diameters of the tubular portion may depend on the intended application and desired dispense characteristics. In some embodiments, a bottom end, or an end opposite the location of the coupler portion 104, may include one or more side wall openings 106. Side wall openings may provide improved dispensing of liquid or other material through the dip tube via the tubular portion 102.

The coupler portion 104, as will be described in further detail in various embodiments herein, may be coupled with or integral with the tubular portion 102. The coupler portion 104 may take on various configurations, but is generally configured at one end to cooperate in fluid communication with a top end of the tubular portion 102 and at the other end to substantially fit into, or adjacent to, the mouth of a particular liner or other container, such as by fitting into or adjacent to, or otherwise coupling with, a fitment portion of the liner or container. In this regard, the coupler portion 104 may be configured to cooperate, or fit, with any suitable liner or container, thus permitting flexible use of tubular portion 102 with any particular model container or other custom container. The coupler portion 104 may generally assist in the proper placement of the tubular portion 102 and generally maintains the tubular portion in fixed relationship with the liner or container during dispense of the contents therein. The coupler portion 104 also includes an interior passageway extending generally from one end to the other, and the interior passageway is in fluid communication with the interior passageway of the tubular portion, such that a fluid or other material may flow from a bottom end of the tubular portion, through the tubular portion and the coupler, so as to exit at a top end of the coupler, often being delivered to a dispense connector and subsequent downstream process, as would be understood by those skilled in the art.

The coupler portion 104 can be coupled with the tubular portion 102 in a variety of ways, for example in friction-fit or press-fit style, thereby snuggly holding the tubular portion 102 in generally fixed attachment with the coupler portion 104 for sealability. Other options include a threaded engagement, or a welded or bonded engagement. In one embodiment, the coupler portion 104 can be overmolded onto the tubular portion 102, or alternatively, the tubular portion 102 overmolded onto the coupler portion 104.

The dip tube assemblies 100 of the present disclosure may be used with any suitable container and/or dispensing system. In some embodiments, dip tube assemblies 100 of the present disclosure may be used with existing container and/or dispensing systems, while in other embodiments, the dip tube assemblies may be specifically configured for compatibility with a custom container and dispensing system. A typical container and/or dispensing system that may be used with dip tube assemblies 100 of the present disclosure is shown in FIG. 2, though it will be understood that the dip tube assemblies of the present disclosure may be used with any suitable container or storage and dispensing system and accordingly contain fewer, more, or different components than those illustrated, for example, in FIG. 2.

Figure 2:
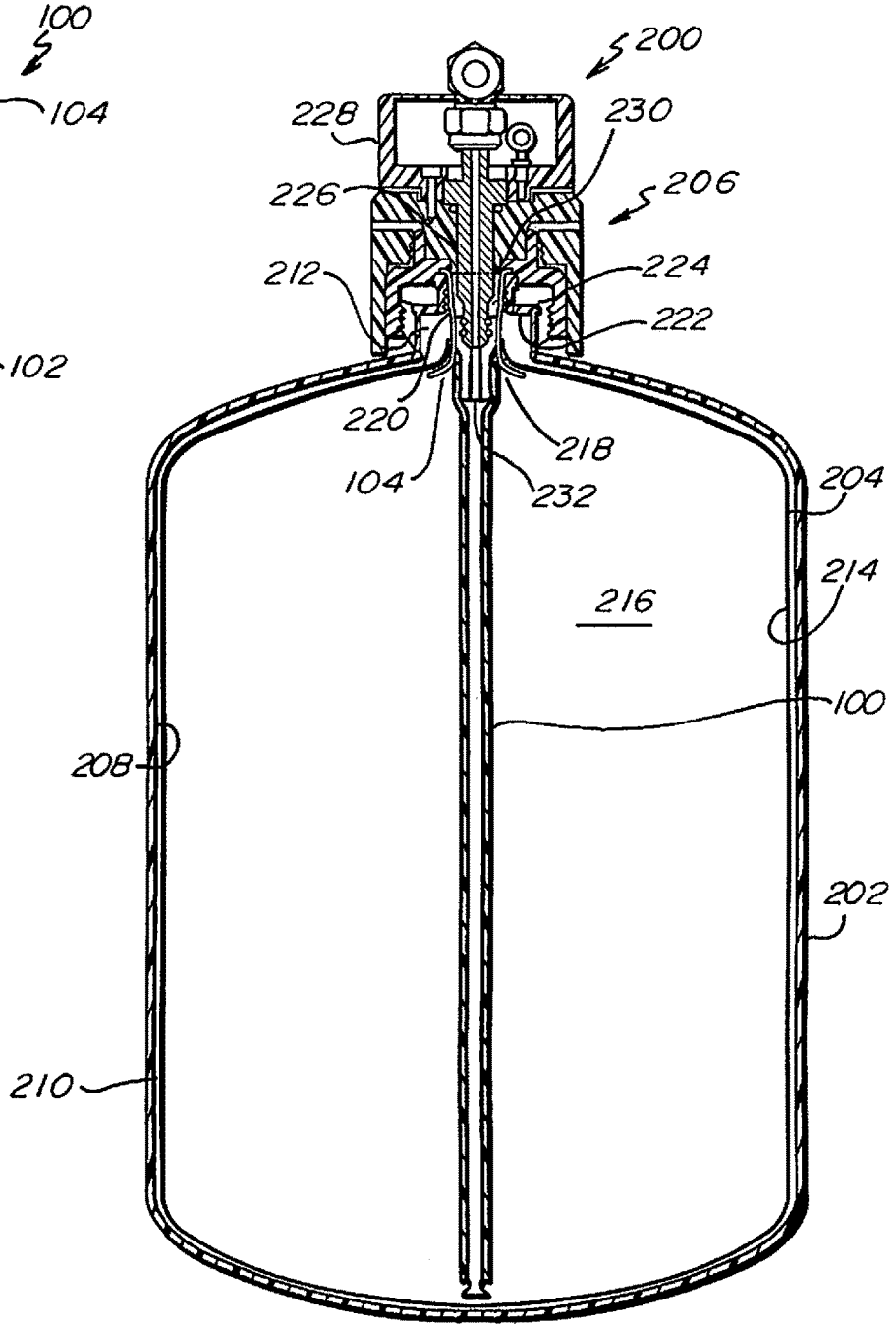
FIG. 2 is a cross-sectional view of a container and/or dispensing system including a dip tube assembly according to one embodiment of the present disclosure.

As shown in FIG. 2, a container and/or dispensing system 200 may include an overpack 202, a liner 204, one or more closures and/or connectors 206, and a dip tube assembly 100 in accordance with various embodiments of the present disclosure. The overpack 202 may include an overpack wall 208, an interior cavity 210, and a mouth 212. The overpack 202 may be comprised of any suitable material or combination of materials, for example but not limited to, metal materials, or one or more polymers, including plastics, nylons, EVOH, polyesters, polyolefins, or other natural or synthetic polymers. In further embodiments, the overpack 202 may be manufactured using polyethylene terephthalate (PET), polyethylene naphthalate (PEN), poly(butylene 2,6-naphthalate) (PBN), polyethylene (PE), linear low-density polyethylene (LLDPE), low-density polyethylene (LDPE), medium-density polyethylene (MDPE), high-density polyethylene (HDPE), polypropylene (PP), and/or a fluoropolymer, such as but not limited to, polychlorotrifluoroethylene (PCTFE), polytetrafluoroethylene (PTFE), fluorinated ethylene propylene (FEP), and perfluoroalkoxy (PFA). The overpack 202 may be of any suitable shape or configuration, such as, but not limited to, a bottle, a can, a drum, etc.

The liner 204, which may be disposed within the overpack 202, may be configured to comprise any desirable shape that is appealing to the user, and/or assists in the collapse of the liner. The liner 204, in some embodiments, may be dimensioned and shaped to substantially conform to the interior of the overpack 202. In a further embodiment, the liner 204 may have a shape, when inflated or filled, that is different from, but complimentary with, the shape of the overpack 202. The liner 204 may include a liner wall 214, an interior cavity 216, and a mouth 218. The mouth 218 of the liner 204 may include a fitment portion 220. The fitment portion 220 may be, but need not be, made of a different material than the rest of the liner 204 and may be harder, more resilient, and/or less flexible than the rest of the liner. The fitment portion 220 may couple with one or more components of closures and/or connectors 206, which may be achieved by any suitable means, such as but not limited to, complementary threading, snap-fit or friction-fit means, bayonet means, or any other suitable mechanism or combination of mechanisms for coupling, as will be appreciated by those skilled in the art. In some embodiments, one or more of the closures and/or connectors 206 may couple to, or may also couple to, the mouth 212 of the overpack 202.

In some embodiments, the liner 204 may be a collapsible liner that is substantially flexible, while in other embodiments the liner may be somewhat rigid but still collapsible, e.g., a rigid or substantially rigid collapsible liner. As used herein, the terms "rigid" or "substantially rigid," in addition to any standard dictionary definitions, are meant to also include the characteristic of an object or material to substantially hold its shape and/or volume when in an environment of a first pressure, but wherein the shape and/or volume may be altered in an environment of increased or decreased pressure. The amount of increased or decreased pressure needed to alter the shape and/or volume of the object or material may depend on the application desired for the material or object and may vary from application to application. In addition, the term "substantially rigid" is meant to include the characteristic of an object or material to substantially hold its shape and/or volume, but upon application of such increased or decreased pressure, tend to give, such as by but not limited to, flexing, bending, etc., rather than breaking.

The liner 204 may be manufactured using any suitable material or combination of materials, such as but not limited to, any of the non-metal materials or combination of materials listed above with respect to the overpack 202. However, the overpack 202 and liner 204 need not be manufactured from the same materials. The liner 204 may have one or more layers and may have any desirable thickness. In one embodiment, for example, a liner 204 may have a thickness of from about 0.05 mm to about 3 mm.

The overpack 202 and liner 204 may each be manufactured using any suitable manufacturing process, such as but not limited to, injection blow molding, injection stretch blow molding, extrusion, welding, etc., and may each be manufactured as a single component or may be a combination of multiple components. In some embodiments, the overpack 202 and liner 204 may be blow molded in a nested fashion, also referred to herein as co-blow molded. Examples of liner-based systems and methods utilizing co-blow molding techniques have been described in greater detail in International PCT Appl. No. PCT/US11/55560, titled, "Nested Blow Molded Liner and Overpack and Methods of Making Same," filed Oct. 10, 2011, which is hereby incorporated herein by reference in its entirety. In some embodiments a liner may be blow molded into an already formed overpack, whereby the overpack may function as the mold for the liner, and may be referred to herein as "dual blow molding," which is described in further detail below. In such embodiments, the overpack may be manufactured by any suitable process.

Example connectors 206 may include but are not limited to, a liner retaining ring 222 for maintaining the liner 204 in proper placement with respect to the overpack 202, a cap 224 or other closure, which may also include a break seal 226, for sealing the contents in the liner 204, and a dispense connector 228, having a probe 230 for operably coupling the dispense connector in fluid communication with the interior passageway 232 of a coupler portion 104 of a dip tube assembly 100 in accordance with various embodiments of the present disclosure.

Further examples and embodiments of the type of liners, dip tube assemblies, dip tubes, couplers, overpacks, and connectors that may be used are disclosed in more detail in: U.S. Prov. Appl. No. 61/831,202, titled "Dip Tube Assemblies and Methods of Manufacturing the Same," filed Jun. 5, 2013; International PCT Appl. No. PCT/US11/55558, titled, "Substantially Rigid Collapsible Liner, Container and/or Liner for Replacing Glass Bottles, and Enhanced Flexible Liners," filed Oct. 10, 2011; International PCT Appl. No. PCT/US11/55560, titled, "Nested Blow Molded Liner and Overpack and Methods of Making Same," filed Oct. 10, 2011; International PCT Appl. No. PCT/US11/64141, titled "Generally Cylindrically-Shaped Liner for Use in Pressure Dispense Systems and Methods of Manufacturing the Same," filed Dec. 9, 2011; U.S. Prov. Appl. No. 61/703,996, titled "Liner-Based Shipping and Dispensing Systems," filed Sep. 21, 2012; U.S. Prov. Appl. No. 61/468,832, titled "Liner-Based Dispenser," filed Mar. 29, 2011 and related International PCT Appln. No. PCT/US2011/061764, filed Nov. 22, 2011; U.S. Prov. Appl. No. 61/525,540, titled "Liner-Based Dispensing Systems," filed Aug. 19, 2011 and related International PCT Appln. No. PCT/US2011/061771, filed Nov. 22, 2011; U.S. patent application Ser. No. 13/149,844, titled "Fluid Storage and Dispensing Systems and Processes," filed May 31, 2000 U.S. patent application Ser. No. 11/915,996, titled "Fluid Storage and Dispensing Systems and Processes," filed Jun. 5, 2006; International PCT Appl. No. PCT/US10/51786, titled "Material Storage and Dispensing System and Method With Degassing Assembly," filed Oct. 7, 2010; International PCT Appl. No. PCT/US10/41629; U.S. Pat. No. 7,335,721; U.S. patent application Ser. No. 11/912,629; U.S. patent application Ser. No. 12/302,287; International PCT Appl. No. PCT/US08/85264; U.S. patent application Ser. No. 12/745,605, filed Feb. 15, 2011; U.S. Prov. Appln. No. 61/605,011, titled "Liner-Based Shipping and Dispensing System," filed Feb. 29, 2012; and U.S. Prov. Appln. No. 61/561,493, titled "Closure/Connectors for Liner-Based Shipping and Dispensing Containers," filed Nov. 18, 2011, each of which is hereby incorporated by reference herein in its entirety. The overpack 202 and liner 204 may include any of the embodiments, features, and/or enhancements disclosed in any of the above noted applications, including, but not limited to, flexible, rigid collapsible, 2-dimensional, 3-dimensional, welded, molded, gusseted, and/or non-gusseted liners, and/or liners that contain folds and/or liners that comprise methods for limiting or eliminating choke-off and liners, for example those sold under the brand names BRIGHTPak® and NOWPak® by ATMI, Inc. Various features of dispensing systems disclosed in embodiments described herein may be used in combination with one or more other features described with regard to other embodiments.

The various embodiments of dip tube assemblies for use with container and/or dispensing systems described herein may be utilized with any suitable dispense process. For example, the various embodiments of dip tube assemblies described herein may be utilized in pressure dispense processes, including direct and indirect pressure dispense, pump dispense, and pressure-assisted pump dispense, including various embodiments of inverted dispense methods disclosed in Korean patent registration no. 10-0973707, titled "Apparatus for Supplying Fluid," which is hereby incorporated by reference herein in its entirety.

Importantly, during any of these aforementioned pressure dispense processes, an undesirable pressure differential between the diptube and the surrounding container may be created, causing unintentional spillage of the chemical stored therein. The embodiments disclosed herein aim to release some of the pressure within the system by incorporating at least one pressure relief feature into the coupler portion of the dip tube assembly.

Figure 3:
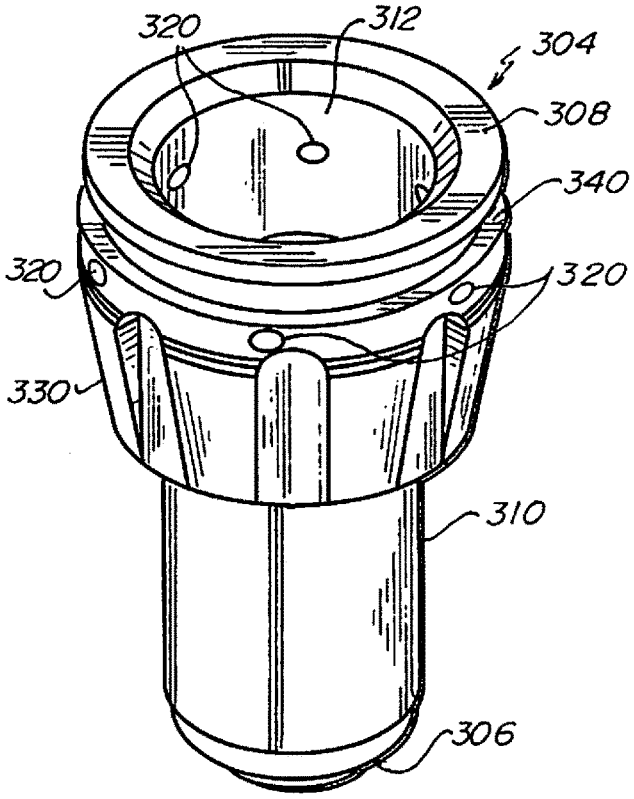
FIG. 3 is a perspective view of a coupler according to one embodiment of the present disclosure.
Figure 4:
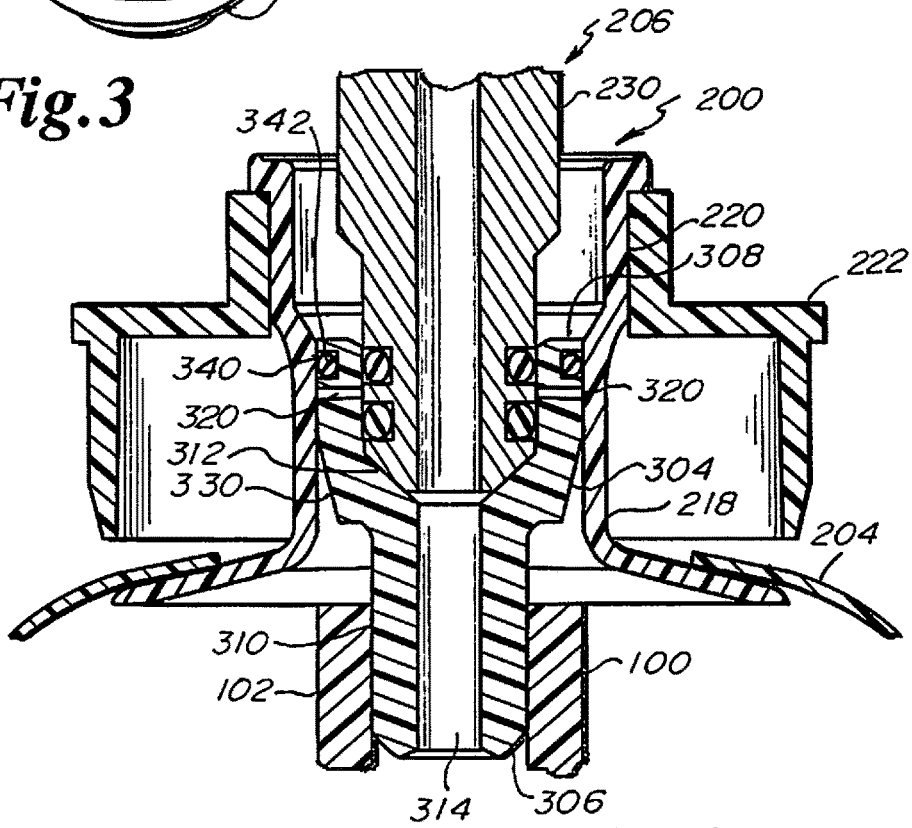
FIG. 4 is a cross-sectional view of a dip tube assembly, in a working position of a container, and having the coupler of FIG. 3.

FIGS. 3-4 illustrate one embodiment of a coupler portion 304 of the dip tube assembly 100 for container 200 according to the present disclosure. FIG. 3 shows the coupler portion 304, and FIG. 4 shows a cross-section of the dip tube assembly 100 and container 200 having coupler portion 304. The coupler portion 304 may be configured at a lower end 306 for connection with the tubular portion 102 and at an upper end 308 for connection with connector 206 having probe 230. Coupler portion 304 may be disposed within the mouth 218 of the liner 204, as shown in FIG. 4. Coupler portion 304 has an outer surface 310 and an inner surface 312, with a thickness therebetween. Inner surface 312 defines a lumen 314 that allows fluid to be conveyed from the tubular portion through the probe 230.

Coupler portion 304 has at least one pressure relief port 320. In the embodiment shown in FIGS. 3-4, the coupler portion 304 has a plurality of pressure relief ports 320. In some embodiments, such as the embodiment shown in FIGS. 3 & 4, pressure relief ports 320 comprising discrete throughholes extending through the thickness of the coupler portion from the outer surface 310 through the inner surface 312. In other embodiments, the at least one pressure relief port 320 defining at least one opening on the outer surface 310 of the coupler portion 304 and at least one opening in the inner surface 312 with a channel connecting the opening in the outer surface 310 to the opening of the inner surface 312. Other configurations of the pressure relief port 320 are contemplated by this invention. In at least one embodiment shown in FIG. 4, when the connector 206 is engaged with the coupler portion 304, the connector 206 (and in some embodiments, more particularly, probe 230), covers or closes the pressure relief port 320.

Any excess pressurized gas or pressure differential can be relieved through the at least one pressure relief port 320 when the connector 206 is removed to prevent undesired spillage of the liquid chemical stored within container 200. In some embodiments, if some of the liquid chemical were to flow up to the coupler portion 304, the at least one pressure relief port 320 would also provide a passage way for the liquid chemical to pass through and then back down into the liner.

As shown in FIGS. 3-4, in at least one embodiment, the outer surface 310 may have a generally circular cross-section, with a first external diameter near the upper end 308 greater than a second external diameter near the lower end 306. In some embodiments, the coupler portion 304 may have a frustoconical portion 330 between the upper end 308 and the lower end 306 extending between the portion with the first external diameter and the second external diameter. In some embodiments, such as shown in FIG. 3, the pressure relief port 320 is positioned between the frustoconical portion 330 and the upper end 308 of the coupler portion 304.

In some embodiments, such as shown in FIG. 3, the frustoconical portion 330 has a plurality of channel-like features 332 defined by ribs 334, the ribs extending axially.

In some embodiments, such as shown in FIGS. 3-4, the coupler portion 304 may include a retaining feature 340 for a sealing mechanism 342, such as an O-ring. The sealing mechanism 342 further prevents gas and fluids from escaping the container between the interior liner and the diptube assembly. In at least one embodiment, as shown in FIG. 3, the pressure relief port 320 is positioned between the sealing feature 340 and/or sealing mechanism 342 and the lower end 306.

Figure 5:
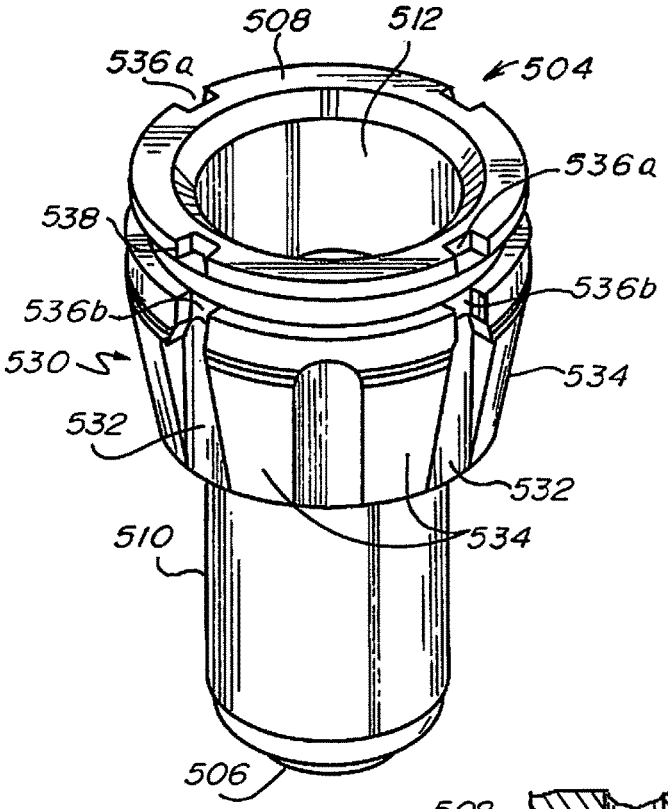
FIG. 5 is a perspective view of a coupler according to one embodiment of the present disclosure.
Figure 6:
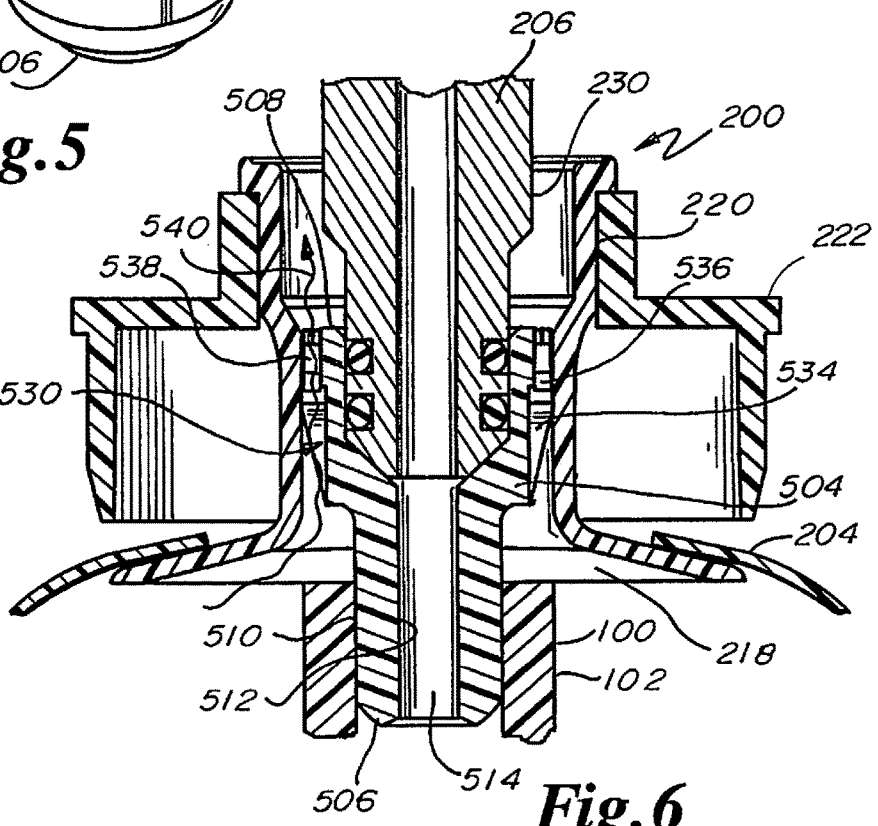
FIG. 6 is a cross-sectional view of a dip tube assembly, in a working position of a container, having the coupler of FIG. 5.

FIGS. 5-6 illustrate another embodiment of a coupler portion 504 of the dip tube assembly 100 for container 200 according to the present disclosure. FIG. 5 shows the coupler portion 504, and FIG. 6 shows a cross-section of the dip tube assembly 100 having coupler portion 504. The coupler portion. 504 may be configured at a lower end 506 for connection with the tubular portion 102 and at an upper end 508 for connection with connector 206 having probe 230. Coupler portion 504 has an outer surface 510 and an inner surface 512, with a thickness therebetween. Inner surface 512 defines a lumen 514 that allows fluid to be conveyed from the tubular portion 102 through the probe 230 or, vice versa, to provide a gas to the container from the pressure source or a negative pressure through the connector 206 and then through tubular portion 102.

As shown in FIGS. 5-6, in at least one embodiment, the outer surface 510 may have a generally circular cross-section, with a first external diameter near the upper end 508 greater than a second external diameter near the lower end 506. In some embodiments, the coupler portion 504 may have a frustoconical portion 530 between the upper end 508 and the lower end 506 extending between the portion with the first external diameter and the second external diameter.

In some embodiments, such as shown in FIG. 5, the outer surface 510 has one or more longitudinal channel features 532 defined by axially extending ribs 534. In at least one embodiment, the channel features 532 and ribs 534 are defined on the frustoconical portion 530. To provide pressure relief for the container, the coupler portion 504 includes a vent pathway defined by a plurality of surface features on the outer surface 510 of the coupler portion. One or more notches 536 are positioned radially about the coupler portion 504 between the frustoconical portion 530 and the upper end 508. In at least one embodiment as shown in FIG. 5, the notches 536 are each aligned with one channel feature 532 to create a pathway for vent gas 540 to exit the container. In some embodiments, there are a plurality of upper notches **536*a* near upper end 508 and lower notches 536*b* near lower end 506 and in at least one embodiment, upper notches 536*a* and lower notches 536*b* are axially aligned. In some embodiments, an annular channel 538 may also be disposed between the frustoconical portion 530 and the upper end 508 to connect the channels 532 with the notches 536 for a desired pathway for fluid flow of the gas. In this embodiment, the pathway can enable vented to exit the container without unseating the coupler portion 304 from the mouth 218** of the container.

Unlike the embodiment shown in FIGS. 3-4, in the embodiment of FIGS. 5-6, a sealing mechanism such as an O-ring is not provided on the outer surface of the coupler portion. However, in some embodiments, to close off the channels 536, a seal, such as an O-ring, may be positioned within annular channel 538.

Figure 7:
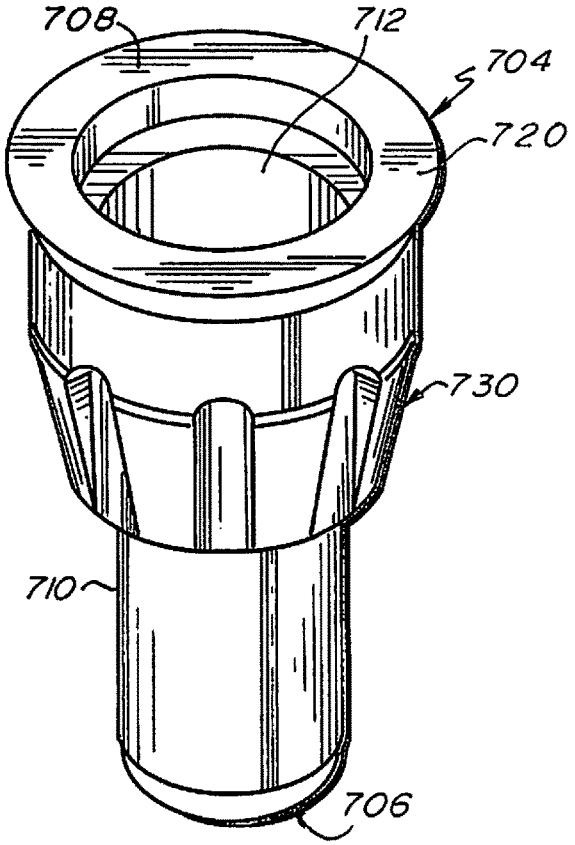
FIG. 7 is a perspective view of a coupler according to one embodiment of the present disclosure.
Figure 8:
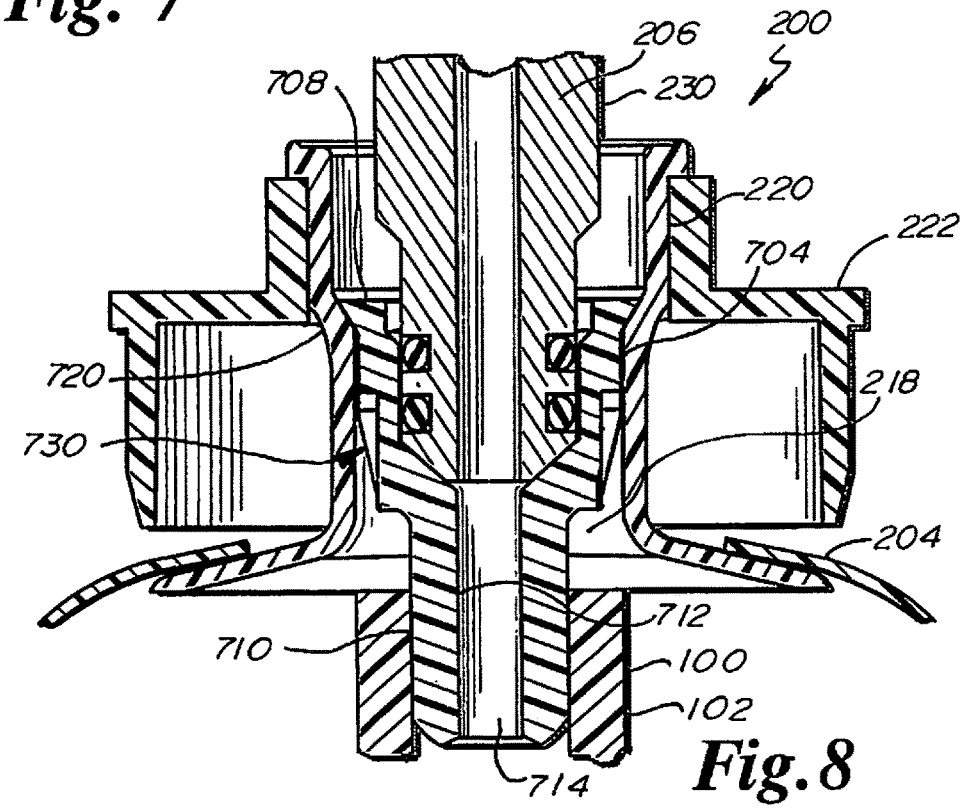
FIG. 8 is a cross-sectional view of a dip tube assembly, in a working position of a container, having the coupler of FIG. 7.

FIGS. 7-8 illustrate another embodiment of a coupler portion 704 of the dip tube assembly 100 for container 200 according to the present disclosure. FIG. 7 shows the coupler portion 704, and FIG. 8 shows a cross-section of the dip tube assembly 100 having coupler portion 704. The coupler portion 704 may be configured at a lower end 706 for connection with the tubular portion 102 and at an upper end 708 for connection with connector 206 having probe 230. Coupler portion 704 has an outer surface 710 and an inner surface 712, with a thickness therebetween. Inner surface 712 defines a lumen 714 that allows fluid to be conveyed from the tubular portion through the probe 230.

Like other embodiments discussed above, a sealing mechanism, such as an O-ring, may or may not be provided. Instead, coupler portion 704 has a lip portion 720 proximate the upper end 708 of the coupler portion 704. The lip portion 720 may have a frustoconical shape as shown or other shapes that allow the lip portion 720 to sealably mate with the inner surface of the mouth 218, particularly the fitment portion 220. When the connector 206 is not attached, internal pressure, if any, in the container 204 may lift the coupler portion 704 enabling excess internal pressure to escape the container between the coupler portion 204 and the mouth 218 of the liner 204.

As shown in FIGS. 7-8, in at least one embodiment, the coupler portion 504 may have a second frustoconical portion 730 between the upper end 708 and the lower end 706.

In some embodiments of a dip tube assembly, such as any of the diptube assemblies of the present disclosure, the diameter of the inner passage way of a dip tube assembly may be consistent and uniform from the end of the tubular portion, through the length of the tubular portion, to where the tubular portion joins the coupler portion, and/or through the inner passage way of the coupler portion. The diameter in such cases may be any desired diameter such that the assembly may be securely positioned in a desired liner and/or overpack, and dispense the contents of a liner effectively and/or efficiently. In other embodiments, however, the diameter of the inner passage way may vary. For example, with regard to any of the embodiments disclosed herein, the inner passage way of the tubular portion may have a diameter that is less than, greater than, or equal to the diameter of the inner passage way in some or all parts of the coupler. More generally, any of the embodiments disclosed herein may include one or more inner diameters along the length thereof, including along the tubular portion and/or the coupler portion, that vary in diameter, and all such embodiments are considered within the scope of the present disclosure.

While each feature of the dip tube assembly 100 may not be described with specific reference to every embodiment, it is recognized and considered within the scope of the present application, that any of the features, or combination of features, described with regard to any one of the embodiments shown in FIGS. 3-8 are applicable to, and may be incorporated into, any of the other embodiments of dip tube assembly 100. For example only, any of the embodiments may use tapering in the interior of the receiving cavity of the coupler portion to increase the amount of grip at the interface between the tubular portion and the coupler portion. Furthermore, any of the embodiments may utilize any of the various retention features disclosed herein.

Any of the dip tube assemblies of the present disclosure, or the various components thereof, such as the tubular portion, coupler portion, or any other additional components, may be manufactured using any suitable manufacturing process, such as but not limited to, injection molding, injection blow molding, injection stretch blow molding, extrusion, etc. In some embodiments, the tubular portion and coupler portion may be manufactured separately, as separate components, while in other embodiments, they may be manufactured as a single, unitary component. Likewise, the tubular portion and/or coupler portion may each separately be comprised of a single unitary element, or they may each be comprised of a combination of multiple elements.

Any of the dip tube assemblies of the present disclosure, or the various components thereof, may be comprised of any suitable material or combination of materials, for example but not limited to, one or more polymers, including plastics, nylons, EVOH, polyesters, polyolefins, or other natural or synthetic polymers. In further embodiments, any of the dip tube assemblies of the present disclosure, or the various components thereof, may be manufactured using polyethylene terephthalate (PET), polyethylene naphthalate (PEN), poly(butylene 2,6-naphthalate) (PBN), polyethylene (PE), linear low-density polyethylene (LLDPE), low-density polyethylene (LDPE), medium-density polyethylene (MDPE), high-density polyethylene (HDPE), polypropylene (PP), and/or a fluoropolymer, such as but not limited to, polychlorotrifluoroethylene (PCTFE), polytetrafluoroethylene (PTFE), fluorinated ethylene propylene (FEP), and perfluoroalkoxy (PFA). Any portion of a dip tube assembly may be comprised of the same or different material(s) than one or more other portions of the dip tube assembly.

The various embodiments of dip tube assemblies for use with container and/or dispensing systems described herein may be utilized with any suitable dispense process. For example, the various embodiments of dip tube assemblies described herein may be utilized in pressure dispense processes, including direct and indirect pressure dispense, pump dispense, and pressure-assisted pump dispense, including various embodiments of inverted dispense methods disclosed in Korean patent registration no. 10-0973707, titled "Apparatus for Supplying Fluid," which is hereby incorporated by reference herein in its entirety.

Examples of some of the types of materials that may be stored, shipped, and/or dispensed using embodiments of the present disclosure include, but are not limited to: ultrapure liquids, such as acids, solvents, bases, photoresists, slurries, detergents, cleaning formulations, dopants, inorganic, organic, metalorganics, TEOS, and biological solutions, DNA and RNA solvents and reagents, pharmaceuticals, printable electronics inorganic and organic materials, lithium ion or other battery type electrolytes, nanomaterials (including for example, fullerenes, inorganic nanoparticles, sol-gels, and other ceramics), and radioactive chemicals; pesticides/fertilizers; paints/glosses/solvents/coating-materials etc.; adhesives; power washing fluids; lubricants for use in the automobile or aviation industry, for example; food products, such as but not limited to, condiments, cooking oils, and soft drinks, for example; reagents or other materials for use in the biomedical or research industry; hazardous materials used by the military, for example; polyurethanes; agrochemicals; industrial chemicals; cosmetic chemicals; petroleum and lubricants; sealants; health and oral hygiene products and toiletry products; or any other material that may be dispensed by pressure dispense, for example. Materials that may be used with embodiments of the present disclosure may have any viscosity, including high viscosity and low viscosity fluids. Those skilled in the art will recognize the benefits of the disclosed embodiments, and therefore will recognize the suitability of the disclosed embodiments to various industries and for the transportation and dispense of various products. In some embodiments, the disclosed embodiments may be particularly useful in industries relating to the manufacture of semiconductors, flat panel displays, LEDs, and solar panels; industries involving the application of adhesives and polyamides; industries utilizing photolithography technology; or any other critical material delivery application. However, the various embodiments disclosed herein may be used in any suitable industry or application.

After dispense is completed or substantially completed and the liner is empty or substantially empty, the end-user may dispose of the dip tube assembly and/or recycle some or all components of the dip tube assembly. In order to assist in making the dip tube assembly described herein more sustainable, the dip tube assembly or one or more components thereof, in some embodiments may be manufactured from biodegradable materials or biodegradable polymers, including but not limited to: polyhydroxyalkanoates (PHAs), like poly-3-hydroxybutyrate (PHB), polyhydroxyvalerate (PHV), and polyhydroxyhexanoate (PHH); polylactic acid (PLA); polybutylene succinate (PBS); polycaprolactone (PCL); polyanhydrides; polyvinyl alcohol; starch derivatives; cellulose esters, like cellulose acetate and nitrocellulose and their derivatives (celluloid); etc. Similarly, in some embodiments, and if suitable for the industry application, the dip tube assembly or one or more components thereof, may be manufactured from materials that can be recycled or recovered, and in some embodiments, used in another process by the same or a different end user, thereby allowing such end user(s) to lessen their impact on the environment or lower their overall emissions. For example, in one embodiment, the dip tube assembly or one or more components thereof may be manufactured from materials that may be incinerated, such that the heat generated therefrom may be captured and incorporated or used in another process by the same or different end user. In general the dip tube assembly or one or more components thereof may be manufactured from materials that can be recycled, or that may be converted into raw materials that may be used again.

In the foregoing description various embodiments of the invention have been presented for the purpose of illustration and description. They are not intended to be exhaustive or to limit the invention to the precise form disclosed. Obvious modifications or variations are possible in light of the above teachings. The embodiments were chosen and described to provide the best illustration of the principals of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth they are fairly, legally, and equitably entitled.

For purposes of interpreting the claims, it is expressly intended that the provisions of 35 U.S.C. 112(f) are not to be invoked unless the specific terms "means for" or "step for" are recited in the respective claim.

What is claimed is:

1. A coupler portion for a dip tube assembly for a container with a liner defining a chamber for a chemical fluid, the coupler portion comprising:

a first end for connection with a connector assembly for supplying a pressure to said container;

a second end for connection with a tubular portion; and an outer surface and an inner surface with a thickness therebetween, wherein said inner surface defines a lumen for conveying a chemical fluid from said tubular portion to said connector assembly, said coupler portion defining at least one pressure relief feature, wherein said at least one pressure relief feature comprises a pressure relief port that defines a through hole extending through said thickness.

2. The coupler portion of claim 1, wherein said pressure relief port further defines a first opening on said outer surface and a second opening on said inner surface, said through hole connecting said first opening and said second opening.

3. The coupler portion of claim 1, wherein said coupler portion includes a frustoconical portion between said second end and said first end.

4. The coupler portion of claim 3, wherein said pressure relief port is disposed between said first end and said frustoconical portion.

5. The coupler portion of claim 3, wherein said frustoconical portion defines a plurality of channel-like features defined by ribs that extend axially.

6. The coupler portion of claim 1, wherein an external diameter of said first end is greater than an external diameter of said second end.

7. The coupler portion of claim 1, further comprising a retaining feature proximate said first end for a sealing mechanism.

8. The coupler portion of claim 7, wherein said sealing mechanism is an O-ring.

9. A coupler portion for a dip tube assembly for a container with a liner defining a chamber for a chemical fluid, the coupler portion comprising:

a first end for connection with a connector assembly for supplying a pressure to said container;

a second end for connection with a tubular portion; and an outer surface and an inner surface with a thickness therebetween, wherein said inner surface defines a lumen for conveying a chemical fluid from said tubular portion to said connector assembly, said coupler portion defining at least one pressure relief feature, wherein the at least one pressure relief feature is defined on the outer surface and comprises an axial channel defined by axially extending ribs, said coupler portion further defining an annular channel proximate said first end, a first notch that passes from said annular channel through said first end, and a second notch that passes from said annular channel into said axial channel.

10. The coupler portion of claim 9, wherein said first notch and said axial channel are axially aligned.

11. A coupler portion for a dip tube assembly for a container with a liner defining a chamber for a chemical fluid, the coupler portion comprising:

a first end for connection with a connector assembly for supplying a pressure to said container;

a second end for connection with a tubular portion; and an outer surface and an inner surface with a thickness therebetween, wherein said inner surface defines a lumen for conveying a chemical fluid from said tubular portion to said connector assembly, said coupler portion defining at least one pressure relief feature, wherein said at least one pressure relief feature comprises a lip portion at said first end of the coupler portion and, wherein said lip portion is frustoconical in shape.

12. A dispensing system, comprising:

an overpack;

a liner disposed in said overpack;

a fitment portion operatively coupled to a mouth of said liner;

a coupler portion, including:

a lower end for connection with a tubular portion;

an upper end for connection with a connector assembly, wherein said connector assembly provides a pressure to said liner; and an outer surface and an inner surface with a thickness therebetween, wherein said inner surface defines a lumen for conveying a chemical fluid from said tubular portion to said connector assembly, said coupler portion defining at least one pressure relief feature, wherein said at least one pressure relief feature comprises a pressure relief port that defines a through hole extending through said thickness.

13. The dispensing system of claim 12, wherein:

said coupler portion is configured for receiving a connector for selective insertion into said coupler portion, said connector closing said pressure relief port when inserted in said coupler portion; and said connector includes a probe that covers said pressure relief port for said closing of said pressure relief port when inserted in said coupler portion.

14. The dispensing system of claim 13, wherein said coupler portion further comprises a retaining feature proximate said upper end that retains a sealing mechanism, said sealing mechanism being seated against an inner surface of said fitment portion.

* * * * *